United States Patent [19]

Thalmann

[11] 4,448,016

[45] May 15, 1984

[54] METHOD OF LUBRICATING A SPINNING OR TWISTING SPINDLE AND A SPINDLE LUBRICATED ACCORDING TO THE METHOD

[75] Inventor: Dieter Thalmann, Winterthur, Switzerland

[73] Assignee: Rieter Machine Works Ltd., Winterthur, Switzerland

[21] Appl. No.: 434,915

[22] Filed: Oct. 18, 1982

[30] Foreign Application Priority Data

Oct. 27, 1981 [CH] Switzerland ..... 6850/81

[51] Int. Cl.[3] ..... D01H 7/20

[52] U.S. Cl. ..... 57/133

[58] Field of Search ..... 57/120, 129, 130, 133, 57/134; 384/322, 385, 388; 184/7 A, 7 CR

[56] References Cited

U.S. PATENT DOCUMENTS

| | | | |
|---|---|---|---|
| 2,548,675 | 4/1951 | McCormack | 57/133 X |
| 3,163,258 | 12/1964 | Thomas | 184/7 C |
| 3,911,659 | 10/1975 | Mandl | 57/133 X |
| 4,022,008 | 5/1977 | Pimiskern et al. | 57/134 X |
| 4,361,004 | 11/1982 | Hartmannsberger | 57/133 X |

*Primary Examiner*—Donald Watkins

*Attorney, Agent, or Firm*—Werner W. Kleeman

[57] ABSTRACT

The invention relates to lubrication of a bearing of a spinning or twisting spindle which comprises a spindle shaft and a fixedly mounted housing. Lubricant is moved in a closed circulation path or system from a reservoir to a bearing arranged above the reservoir and back again to the reservoir. According to the invention, the spindle shaft is rotatably connected with the reservoir and is provided with a tube or pipe fixed to the housing and immersing into the reservoir. The tube is provided at its end which is immersed in the reservoir with an inlet opening towards which the lubricant flows during the start of the rotation of the reservoir. Thus, a back or dam-up pressure forms at the inlet opening of the tube, by means of which the lubricant is propelled upwardly within the tube forming a closed circulation path, emerges from an exit or outlet opening of the tube and again flows back through the bearing into the reservoir. The position of the tube or inlet opening, as the case may be, is chosen in such a manner that the inlet opening is located externally of the lubricant, which is driven by centrifugal force against a side wall of the reservoir, upon reaching the maximum rotational speed of the lubricant. By appropriately proportioning the spindle dimensions and the quantity of lubricant, a vigorous lubrication is achieved during start-up of the spindle, and a complete interruption of the circulation path is attained at full rotational speed because of the centrifugal force. Thus, no additional (drive) energy is required for purposes of lubrication during the normal spinning process.

10 Claims, 2 Drawing Figures

METHOD OF LUBRICATING A SPINNING OR TWISTING SPINDLE AND A SPINDLE LUBRICATED ACCORDING TO THE METHOD

BACKGROUND OF THE INVENTION

The present invention relates to a new and improved method of lubricating a spinning or twisting spindle, and furthermore, pertains to a spindle lubricated in accordance with the inventive method.

In its more particular aspects there is disclosed a method for lubricating a bearing of a spinning or twisting spindle which comprises a spindle shaft, a fixedly mounted housing and a reservoir containing a liquid lubricant. The bearing is secured to and enclosed by the housing. The spindle shaft is rotatably retained by the bearing, and the lubricant is moved in a closed cycle or circulation path or system from the reservoir to the bearing, which is arranged above the reservoir, and back again to the reservoir.

With heretofore known methods of lubricating spindles, the lubricant is upwardly raised from a reservoir, and thereafter, during the course of the downward flow of the lubricant, such lubricant is conducted over the parts which are to be lubricated for the purpose of lubricating the same. Various operating methods are known for elevating or upwardly raising the lubricant.

Thus, in accordance with German Pat. No. 155,356 the lubricant rises along the spindle, emerges at an end of a bearing mounted at the top of the spindle, and again passes back into a housing of a neck bearing. According to the teachings of British Pat. No. 698,141 oil is propelled by centrifugal force against an internal wall of a cylinder. Consequently, the oil is upwardly splashed, and thus, passes through an upper bearing and a lower bearing.

In U.S. Pat. No. 2,780,049, during rotation of a tube oil is upwardly transported into an annular or ring-shaped space. Thus, a lower bearing is lubricated. With increasing speed of rotation, the oil can be upwardly transported up to the region of an upper bearing.

In German Pat. No. 455,211 there is disclosed an apparatus having an upwardly widening or enlarging spindle shaft, wherein during the rotation of such spindle shaft oil is moved upwardly along the shaft. The return movement of the oil occurs along an internal wall of a bore.

In German Pat. Nos. 486,106, 538,624 and 654,948 there are disclosed apparatuses in which oil is upwardly transported by means of a spiral groove or helical groove.

The state-of-the-art constructions are associated with the disadvantage that, during the greatest loading of the spindle drive, in other words during the highest rotational speed thereof, or stated in another way, during the normal winding operation of the spindle, the loading of the spindle drive which is caused by the infeed of the lubricant is also at its greatest. The coincidence of these maximum loadings is disadvantageous for the drive, since there is required an increased expenditure in energy.

SUMMARY OF THE INVENTION

It is therefore a primary object of the present invention to avoid such drawback.

Another noteworthy object of the present invention is concerned with a new and improved method of lubricating a spinning or twisting spindle and a spindle lubricated according to the method, which are not afflicted with the aforementioned drawbacks and shortcomings of the prior art proposals.

Now in order to implement these and still further objects of the invention, which will become readily apparent as the description proceeds, the method of the present development is manifested by the features that the reservoir co-rotates with the spindle shaft, a stationary tube secured to the housing immerses or dips into the reservoir and forms the portion of the circulation path or system leading from the reservoir to the bearing. At the start of the spindle rotation the lubricant contained in the reservoir, prior to attaining its maximum rotational speed or velocity, flows towards an opening provided at the immersed end of the tube, so that there is formed a back or dam-up pressure at the opening. The position of the tube is selected in such a manner that the opening, upon reaching the maximum rotational velocity of the lubricant, is located externally of the lubricant located in the reservoir and subjected to centrifugal force.

As alluded to above the invention is not only concerned with the aforementioned method aspects, but also relates to a spinning or twisting spindle containing a bearing lubricated in accordance with the inventive method and rotatably supporting the spindle shaft. The spindle shaft and the reservoir are interconnected with one another and are rotatable about a common axis. The reservoir is constituted by an upwardly open container, the sidewall of which is provided with an upper edge which extends inwardly towards the housing which extends from above into the reservoir. The part or portion of the circulation path or system leading from the reservoir to the bearing is formed by a tube extending from the reservoir to the bearing and having a discharge or exit opening located above the bearing.

Thus, the invention particularly provides the advantage of a lubricating method which is specifically accommodated to the spinning process. Specifically, at the start of the formation of a winding the oil which co-rotates with the reservoir is driven through the bearing. Hence, there is obtained a vigorous lubrication of the bearing. Due to the centrifugal force, the lubricant in the reservoir is forced against the side wall of such reservoir as a function of the degree to which the lubricant in the reservoir has attained the full rotational speed. The tube or pipe is positioned in the reservoir at such a spacing from its sidewall and from its floor or base that, upon attaining this full rotational speed, in other words during the normal operation of the spindle, no further oil flows against the tube and thus against the opening provided in the end of the tube immersing into the reservoir. Consequently, during the normal operation of the spindle no further oil passes into the tube, and thus no further braking effect is exerted upon the rotating reservoir. Hence, with the spindle construction of the invention there is attained, during the start of the winding of a bobbin, a very intensive lubrication which is fully adequate until there has been accomplished the complete winding of such bobbin. At the same time, during the normal winding operation there is not required any energy for circulation of the lubricant.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
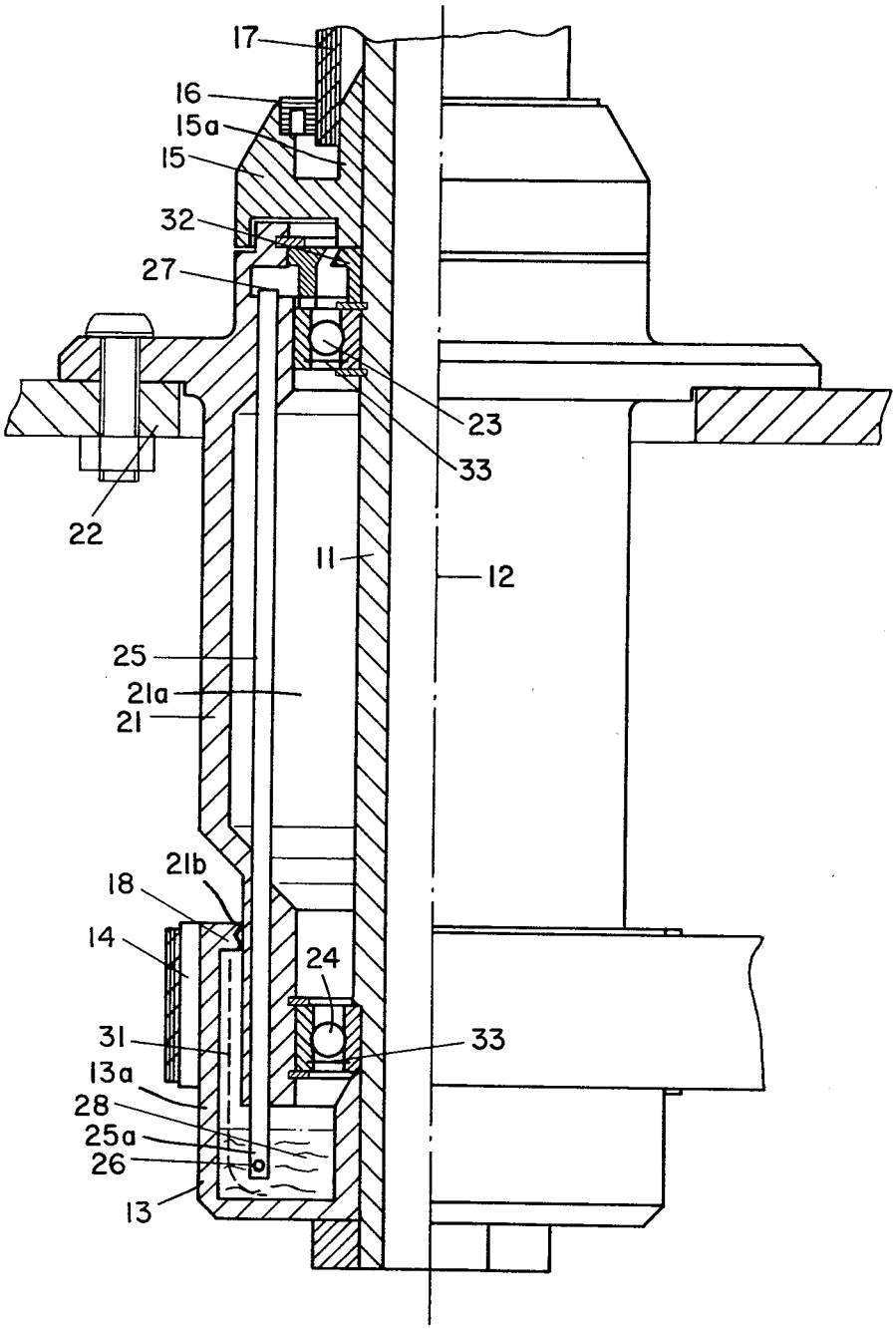
FIG. 1 illustrates at the right-hand portion thereof a side view and at the left-hand portion thereof a longitudinal section of a lower portion of a spindle.

Describing now the drawings it is to be understood that only enough of the spinning or twisting spindle has been shown therein as needed to enable those skilled in the art to readily understand the underlying principles and concepts of the invention and to simplify the illustration of the drawings. Turning attention now specifically to FIG. 1, there is depicted a hollow cylindrical spindle shaft 11 which is rotatable about an axis 12. An oil reservoir or container 13 is fixedly mounted upon the rotatable spindle shaft 11 and is rotatable in conjunction therewith about the rotational axis 12. This lubricant reservoir 13 is provided with a drive whorl 14. Additionally, there is provided a clamping ring 15 which is firmly fixed on the spindle shaft 11 and is likewise rotatable therewith. A bobbin 17, which for instance serves for winding up a thread, can be donned between the cylindrical portion 15*a* of the clamping ring 15 seated upon the spindle shaft 11 and a seal or packing 16 carried by the clamping ring 15. At the upper end of the spindle shaft 11, which has not been particularly illustrated in the drawings, there is located a conventional spindle head which also serves for retaining the donned bobbin 17. The side wall or wall means 13*a* of the reservoir 13 is provided with an upper lip or edge 18 which extends inwardly. A liquid lubricant 28, for instance oil, is located in the reservoir 13.

A housing 21 is secured, for instance by means of threaded bolts or screws, to a spindle band 22. This housing 21 possesses a substantially hollow cylindrical configuration and is arranged coaxially with respect to the rotational axis 12. A suitable neck or journal bearing 23 and a foot bearing 24 are secured to the housing 21. The spindle shaft 11 rests upon the bearings 23 and 24 and is rotatably supported thereby. The housing 21 encloses the bearings 23 and 24. Additionally, this housing 21 forms an enclosed space or compartment 21*a* which extends between the bearings 23 and 24. A vertically disposed oil feed tube or pipe 25 is fixedly secured to the housing 21. At its lower end 25*a* this tube or pipe 25 contains an inlet opening or orifice 26 which is located at the front side of the tube or pipe 25 with respect to the direction of rotation of the reservoir 13.

In order to wind-up a thread or roving upon the bobbin 17 during operation of the equipment, the bobbin 17 is donned on to the spindle as shown in FIG. 1. The reservoir 13 and spindle shaft 11 are then placed into rotation by means of a suitable drive belt or equivalent drive element which drives the whorl 14. Consequently, the clamping ring 15 and the bobbin 17 are also entrained. The rotation occurs in such a rotational sense that the portion or half of the reservoir 13 arranged to the left-hand side of the rotational axis 12 in the drawing of FIG. 1 moves rearwardly away from the observer of such drawing. Since the opening or orifice 26 is located on the side of the tube or pipe 21 facing towards the observer, in other words, at the front side of the tube 25 relative to the rotational movement of the reservoir 13, the lubricant 28 flows with increasing intensity towards the inlet opening or orifice 26 with increasing rotational speed. Thus, a dam-up or back pressure is formed, by means of which the lubricant 28 begins to ascend along the riser tube 25 in order to finally flow out of the discharge or exit opening 27, i.e., the upper opening of the tube 25. The lubricant passes through this discharge opening 27 to the neck bearing 23, flows through such bearing 23, and thereafter flows downwardly along the walls of the parts 11, 21 and 25 and through the foot bearing 24 back into the reservoir 13. Consequently, there is attained a vigorous lubrication of the bearings 23 and 24, in particular at the beginning of the rotation of the bobbin 17, by the action of the lubricant 28 flowing along a circulation path in the described manner.

During the further increase of the rotational speed of the lubricant 28 contained within the reservoir 13, such lubricant is increasingly more intensely pressed against the side wall 13*a* of the reservoir 13 by virtue of the centrifugal force, so that such lubricant tends to upwardly ascend along the reservoir wall 13*a*. Hence, after the spindle has achieved its normal operational speed of rotation, the lubricant 28 is distributed in the reservoir 13 in the manner approximately indicated by the broken line or curve 31. It should be apparent that under these circumstances no further lubricant 28 flows against the tube or pipe 25 and its opening or orifice 26, and thus, also no further lubricant flows upwardly in the tube 25, so that the lubricant feed ceases. The lubricant 28 which was fed through the tube or pipe 25 to the bearings 23 and 24 is completely sufficient until the bobbin has been completely wound and must be again exchanged, or until the spindle otherwise comes to a standstill. With the stopping of the circulation of the lubricant no further drive energy for such circulation must be provided. The lip or edge 18 prevents the lubricant 28 from flowing upwardly out of the reservoir 13. This sealing action is further improved in that the lip or edge 18 forms a sealing gap, generally indicated by reference character 21*b* with the housing 21. This sealing gap 21*b* also prevents contamination of the lubricant 28 by fiber fly or other contaminants.

In accordance with the teachings of the present invention there is available a lubricating process, wherein upon start-up of the equipment, there automatically occurs an intensive feed of lubricant which is readily sufficient for the duration of the winding of a bobbin. The feed of lubricant 28 is completed upon reaching the normal operating conditions, so that no further energy whatsoever is required for the circulation of the lubricant during normal operation.

Figure 2:
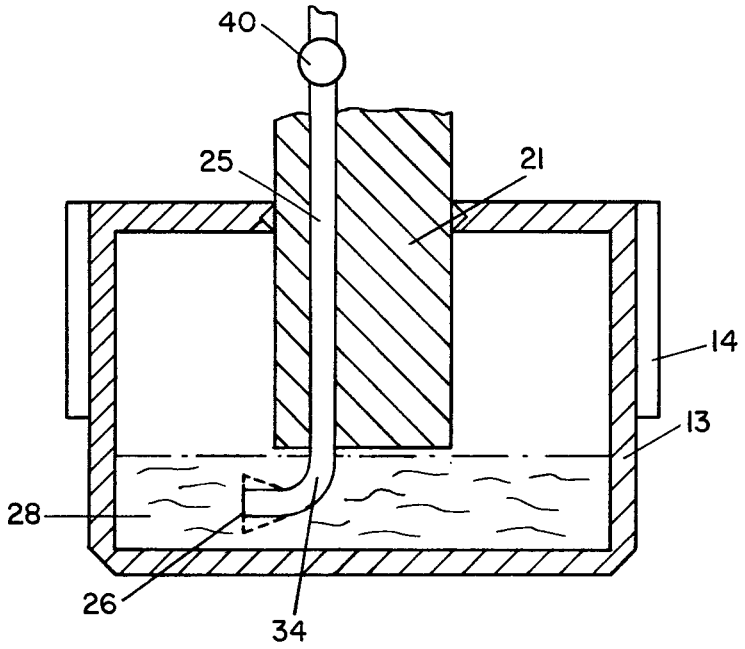
FIG. 2 illustrates in sectional view the lower portion of a tube used in the arrangement of FIG. 1, the sectional view being taken along a plane located perpendicular to the plane of the drawing of FIG. 1 and lying in the lengthwise axis of the tube, and also depicting a somewhat modified construction of the oil feed tube or pipe.

In the illustrated exemplary embodiment the opening or orifice 26 at which there is formed the dam-up or back pressure and by means of which the lubricant 28 enters the tube or pipe 25, is located at the end 25*a* of the tube 25 which dips into the reservoir 13. A somewhat different embodiment is depicted in FIG. 2. Here, there have again been shown the reservoir 13, the whorl 14, a part of the housing or support 21 and the tube 25. According to this embodiment, the tube or pipe 25 includes a tube end piece 34 which is located at the end of the part of the tube 25 disposed within the reservoir 13. The lubricant 28 which rotates in conjunction with the reservoir 13 essentially impinges from the left-hand side of the showing of FIG. 2 at the opening 26, produces a dam-up or back pressure at such opening 26, and then is driven thereby into the tube or pipe 25 and upwardly propelled through the latter. The tube end or terminal piece 34 is bent in such a manner that it extends away from the tube 25 opposite the rotational sense or direction of the reservoir 13. It produces a more gradual diversion of the lubricant 28 upwardly from its horizontal direction of movement than is the case with the provision of a simple opening according to the embodiment of FIG. 1. Thus, the resistance to flow of the lubricant is less than if there were merely provided an opening. The inflow of the lubricant can be made still easier if the inlet opening formed by the tube end piece 34 is configured to process a substantially trumpet shape, as has been illustrated by the dotted lines of FIG. 2.

To ensure that no lubricant 28 can pass through the exterior which, as is well known, is of considerable significance when dealing with textile products, it is desirable to provide an oil spray ring or throw ring 32 above the location where the lubricant emerges from the discharge or outlet opening 27 of the tube 25 in order to pass to the neck bearing 23. In this way there can be avoided any further ascent of the lubricant 28. To ensure that the oil spraying from the ring 32 passes back again into the reservoir 13, this ring 32 must be located within the space enclosed by the housing 21.

The quantity of lubricant 28 flowing through the tube or pipe 25 can be made to be adjustable, and thus, can be accommodated to the encountered circumstances. This is achieved, for instance, by providing an adjustable or variable flow cross-section of the tube 25, for instance by incorporating a valve, as schematically indicated in FIG. 2 by reference character 40, or by squeezing the tube or pipe 25 which can be formed of a suitable flexible material. On the other hand, the inlet tube portion 34 can be directed more or less exactly against the flow of the lubricant 28, that is positioned more or less exactly in the tangential direction relative to the rotation of the reservoir 13. On the other hand, the transported quantity of lubricant can be varied by adjusting the speed of rotation of the reservoir 13 which starts to rotate or accelerate. For instance, the supplied quantity of lubricant is large if the speed of rotation of the lubricant 18 is maintained for a relatively long period of time at a value where it still directly impinges against the inlet opening or orifice 26.

In the event that it is desirable to slow down the throughput velocity of the oil, for instance, during use of a relatively thin or non-viscous oil, then partially permeable sealing discs 33 or equivalent structure can be provided in the through-flow region of the bearings 23 and 24 as shown in FIG. 1.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. In a method of lubricating a bearing of a spinning or twisting spindle containing a spindle shaft, a fixedly mounted housing cooperating with said spindle shaft, a reservoir containing a liquid lubricant therein, the bearing being secured to and enclosed by the housing and the spindle shaft being rotatably supported by the bearing, the lubricant moving in a closed circulation path from the reservoir to the bearing which is arranged above the reservoir and back again to the reservoir, the improvement which comprises the steps of:

immersing a stationary tube which is secured to the housing so as to dip at one end of the tube into the reservoir and forming a portion of the closed circulation path leading from the reservoir to the bearing;

placing the spindle shaft and reservoir into rotation;

causing the lubricant within the reservoir, at the start of rotation of the spindle shaft and reservoir and before reaching a maximum speed of rotation, to flow against an inlet opening provided at the immersed end of the tube in order to form a back pressure at the inlet opening; and selecting the position of the tube such that upon reaching the maximum speed of rotation of the lubricant the inlet opening is located outside the region of the lubricant present in the reservoir and which lubricant is subjected to centrifugal force.

2. The method as defined in claim 1, further including the steps of:

accommodating the increase in rotational speed of the spindle shaft and reservoir to the lubrication requirements at the beginning of rotation of the spindle shaft.

3. An apparatus for lubricating a bearing of a spinning or twisting spindle arrangement comprising:

at least one bearing rotatably supporting a spindle shaft of the spindle arrangement;

a reservoir for housing a lubricant for lubricating the bearing;

said spindle shaft and said reservoir being interconnected with one another for rotation about a common axis of rotation;

said reservoir comprising an upwardly open container;

a housing extending from above into the reservoir;

said reservoir having a side wall provided with an upper edge which extends inwardly towards said housing;

said upper edge together with the housing forming a sealing gap;

a tube leading from the reservoir to the bearing and forming a portion of a circulation path for the lubricant extending from the reservoir to the bearing; and said tube having a discharge opening located above the bearing.

4. The apparatus as defined in claim 3, wherein:

said housing encloses a predetermined space;

said at least one bearing comprises a neck bearing;

a foot bearing provided in spaced relationship from said neck bearing and supporting said spindle shaft;

said neck and foot bearings rotatably supporting said spindle shaft for rotational movement about a vertically extending axis of rotation;

the discharge opening of said tube being located above said neck bearing; and said circulation path extending from the neck bearing to the foot bearing within said space enclosed by the housing and thereafter leading back to the reservoir.

5. The apparatus as defined in claim 3, wherein:

said tube has an end portion located in said reservoir;

said tube comprises at said end portion located in the reservoir a tube end piece which is bent in substantially horizontal direction;

said bent tube end piece extending away from the tube in a direction opposite to the rotational direction of the reservoir; and said tube end piece being provided with an inlet opening for the lubricant.

6. The apparatus as defined in claim 3, further including:

means for the adjustment of the quantity of lubricant flowing through the tube.

7. The apparatus as defined in claim 6, wherein:

said adjustment means comprises a tube formed of a squeezable material.

8. The apparatus as defined in claim 6, wherein:

said adjustment means comprises valve means for varying the cross-sectional area of the tube.

9. The apparatus as defined in claim 3, further including:

a semi-permeable sealing disc provided at a lubricant through-flow region of said at least one bearing for slowing the throughflow of lubricant through said at least one bearing.

10. The apparatus as defined in claim 3, wherein:

said housing encloses a predetermined space;

the space enclosed by the housing extending upwardly beyond the bearing;

a lubricant throw ring provided above the discharge opening of the tube; and said throw ring being located within said enclosed space and being seated on the spindle shaft and secured thereto.

* * * * *